United States Patent [19]

Goffman et al.

[11] Patent Number: 4,511,443

[45] Date of Patent: Apr. 16, 1985

[54] METHOD OF THIOUREA ADDITION TO ELECTROLYTIC SOLUTIONS USEFUL FOR COPPER REFINING

[75] Inventors: Martin Goffman, Edison, N.J.; Thomas L. Jordan, Amarillo, Tex.

[73] Assignee: ASARCO Incorporated, New York, N.Y.

[21] Appl. No.: 606,061

[22] Filed: May 1, 1984

Related U.S. Application Data

[63] Continuation of Ser. No. 514,538, Jul. 19, 1983, Pat. No. 4,474,649, which is a continuation of Ser. No. 390,733, Jul. 21, 1982, abandoned, which is a continuation of Ser. No. 236,965, Feb. 23, 1981, abandoned.

[51] Int. Cl.[3] ..... C25C 1/12

[52] U.S. Cl. ..... 204/108

[58] Field of Search ..... 204/108, 106–107

[56] References Cited

U.S. PATENT DOCUMENTS 2,660,555 11/1953 Schloen et al. ..... 204/108

3,389,064 6/1968 Schloen et al. ..... 204/108

*Primary Examiner*—R. L. Andrews

*Attorney, Agent, or Firm*—John J. Tomaszewski; Kenneth A. Koch

[57] ABSTRACT

A process for precise controlling of thiourea concentrations in a copper sulfate, sulfuric acid solution used in copper refining has permitted improvements in tankhouse current efficiencies and the quality of the refined copper deposited on the cathodes.

5 Claims, 3 Drawing Figures

METHOD OF THIOUREA ADDITION TO ELECTROLYTIC SOLUTIONS USEFUL FOR COPPER REFINING

This is a continuation of Ser. No. 514,538 filed July 19, 1983, now U.S. Pat. No. 4,474,649, which application is a continuation of Ser. No. 390,733, filed July 21, 1982, now abandoned, which application is a continuation of Ser. No. 236,965, filed Feb. 23, 1981, now abandoned.

BACKGROUND OF THE INVENTION

This invention is concerned with the electrolytic refining of copper, and more particularly, with a process for constantly maintaining an effective thiourea concentration in the electrolyte solution during the electrolytic refining of copper.

Traditionally, copper has been purified in a process wherein an electric current is transmitted between cast anodes of impure copper to cathodes which have a substantially pure copper deposit plated thereto, both anodes and cathodes being immersed in a suitable electrolyte. The electrolyte which has found universal acceptance in the art is an aqueous solution of copper sulfate and sulfuric acid. The refining process first dissolves the impure anode copper into the electrolyte solution and then transports the copper ions ($Cu^{2+}$) to a nearby cathode, where the copper is plated out as virtually pure metal, $Cu^{\circ}$. After a period of time a desired thickness of copper is deposited on the cathodes, whereupon they are removed and later melted for casting into several common product shapes.

Several problems occur during this operation and have consequently formed the subject of extensive research. As the cost of energy continues to soar, the importance of increasing current efficiency in electrorefining has become a paramount consideration. A change of 1% in the current efficiency of a large modern electrolytic copper refinery can result in a substantial increase in copper capacity, or a decrease in electricity per unit of production. Additionally, it is desired to operate at higher tankhouse current densities without sacrificing current efficiency. Such an improvement would permit a larger and quicker recovery of copper, as well as several desirable by-products, e.g., silver, and would also reduce the need for shift work, thus lowering the cost of labor.

Various addition agents, such as those disclosed in U.S. Pat. Nos. 2,660,555 and 3,389,064, have assisted in improving the quality of the copper deposited on the cathodes. In particular, the addition of a combination of glue, Avitone and thiourea; "thiourea" hereafter being understood to represent either pure or commercial grade thiourea; as well as most organic compounds which contain a thiourea group, as disclosed in U.S. Pat. No. 3,389,064 has been found to favor the formation of a smooth, dense, uniform cathode copper deposit. Without the use of such additives the copper deposited on the cathodes tends to develop "nodules", which are irregular, tree-like growths that often cause harmful short circuits in the process. Also, large "striations", which are groovelike growths in the cathode can trap impurities present in the electrolyte, and are particularly dangerous when the impurity concentration, and it has been thought, especially the thiourea concentration, rise to undesirable levels in the electrolyte.

A problem created by the use of additives has been the need to quickly and accurately determine optimum operating concentrations in the refining tankhouse, and also how to maximize the current efficiency during the plating process. U.S. Pat. No. 3,389,064 does not reveal the chemistry of the disclosed additives in the electrolyte, but rather assumes that the addition agents appear to be used up during the electrolytic refining process. However, in any large commercial process, including tankhouse refining, successful operation can depend on a number of variables, and thus it is desired to discover a method of quickly and accurately measuring the critical parameters in the system in order to keep it constantly running under maximum operating conditions, while not having to resort to old fashioned trial-and-error readjustments, and also determining the ranges of additive concentrations in which copper refining should be conducted.

OBJECTS OF THE INVENTION

Accordingly, it is an advantage of this invention to provide an improved process useful for the electrolytic refining of copper.

It is another advantage of this invention to provide an improved electrolytic copper refining process which increases current efficiency, thus reducing operating costs and labor requirements.

It is another advantage of this invention to determine how various concentrations of thiourea in the electrolyte affect the quality of the cathode deposited copper.

SUMMARY OF THE INVENTION

These and other advantages of the invention are accomplished by an improved method for the electrolytic refining of copper comprising creating an electrolyte useful in copper refining including an aqueous solution of sulfuric acid and copper sulfate, together with minor amounts by weight of addition agents, one of which is thiourea, the electrolyte residing during plating in a suitable container means, which has both an inlet stream and an outlet stream of electrolyte passing through inlet and outlet flow passage means; adding at least a sufficient amount of thiourea to the inlet stream in order to maintain the outlet stream concentration of thiourea at a value at least above trace concentrations, that is, at least a measurable amount, the maximum acceptable concentration in the outlet stream being a value above which cathode deposited copper contamination becomes significant, that is, above which impurities present in the electrolyte materially affect the quality of the deposited copper, and at least periodically repeating the above while electrorefining copper in the container means.

DETAILED DESCRIPTION OF THE INVENTION

It has been estimated that about 95% of all copper produced today is electrolytically refined during its processing from the mined ore state into a finished product. Electrorefining is a process of first electrochemically dissolving impure copper from an anode and then selectively plating the dissolved copper in virtually pure form onto a cathode. Such a process thus serves two purposes; it virtually eliminates impurities which are harmful to the electrical and mechanical properties of copper, and it also separates valuable impurities from the copper, which can be either recovered as by-product metals if economically feasible, or otherwise disposed of.

Figure 1A:
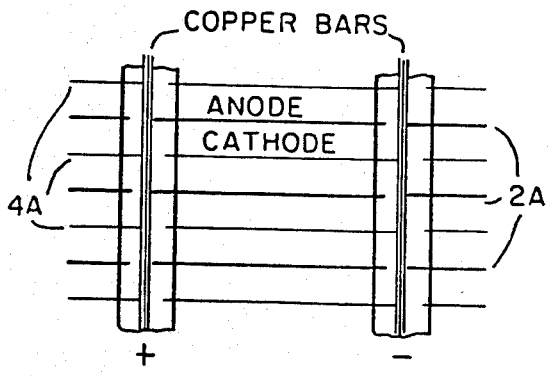
FIG. 1 discloses an overview of two alternative electrically parallel arrangements of arranging the anodes and cathodes in an electrolytic cell.
Figure 1B:
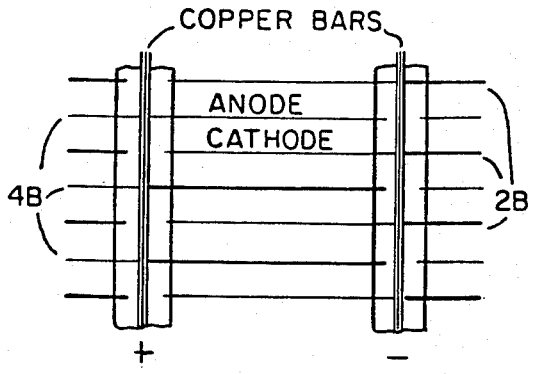

Electrorefining as practiced in industrial tankhouses today is almost exclusively carried out using the "multiple" or "parallel" system, in which all the anodes and cathodes in each electrolytic cell are interleaved in an electrically parallel arrangement. Viewing FIGS. 1A and 1B, two alternative arrangements of arranging anode-cathode and cell connections are illustrated. In each embodiment all the anodes 2A, 2B in a particular cell are activated at one electrical potential, while all the cathodes 4A, 4B are at a second, lower potential. Each anode 2A, 2B is positioned between two cathodes 4A, 4B in order that all the anodes will dissolve at a substantially uniform rate.

All of the individual cells are electrically connected in series to form a section, and each section, generally made up of about 20–45 cells, constitutes a separate independent part (module), of the refinery tankhouse, which can be electrically and chemically isolated from the other sections for such operations as inserting and removing electrodes, cleaning anode residues from the bottom of the cell, and maintenance services.

Since each adjacent cell is connected in series with its adjoining member, all the cathodes in each cell are in direct connection, i.e. the same potential, with the anodes in the adjoining cell.

The electrolyte used for copper refining today is an aqueous solution of about 40–50 g/l copper and 175–225 g/l sulfuric acid, along with small amounts of impurities, mainly nickel, arsenic, iron and antimony. Steam heaters keep the solution at a temperature of about 60°–65° C. at the refining cell inlet, and as the electrolyte circulates through the cells while processing the copper, its temperature drops to a range of about 55°–60° C. at the outlet. The flow rate, or circulation of the electrolyte in and out of the cell causes the typical large industrial cell to recirculate its electrolyte once every 5–6 hours. Such circulation is essential for several reasons, one of which is to transport dissolved impurities out of the cell and to insure uniform copper ion concentrations at the electrode surfaces.

The electrolyte has several "addition agents" which are added to it in an effort to improve performance. If these addition agents were not mixed into the electrolyte the finished plated copper deposits would become either soft or coarsely crystalline deposits. The growth of copper "nodules" on the cathodes, which frequently grow until they touch a nearby anode, thus causing a short circuit, would be promoted, requiring additional manpower for their removal as well as lowering tankhouse current efficiency. Common addition agents found in refinery use today are bone glue, hydrolysed casein, sulphonated wood fibres such as goulae, bindarene and lignone and petroleum liquors, particularly the well known "Avitone A". One such additive which has been found to be extremely significant in the optimization of refinery potential is the usage of thiourea in controlled amounts. As used herein, thiourea means any organic compound containing a thiourea nucleus, viz.

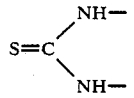

and in particular, commercially pure or commercial grade thiourea.

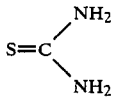

However, due to the small amounts of thiourea involved, usually parts per million of electrolyte, and particularly due to the difficulty in measuring these concentrations in the electrolyte, the behavior of thiourea in copper refining solutions is substantially unknown. In particular, the rate, or rates at which thiourea is consumed during tankhouse operation, the effect of various concentration levels of thiourea have on the deposited copper cathodes, and the effect of rising levels of impurities in the electrolyte, are matters of great interest. Traditionally, the industry has operated very unscientifically in the manner it has regulated the growth of nodules and striations, improving of current efficiency, and the quality of the copper deposited on the cathodes. Consequently, it has been a goal of the industry to design a process of better understanding and controlling these various phenomena.

Figure 2:
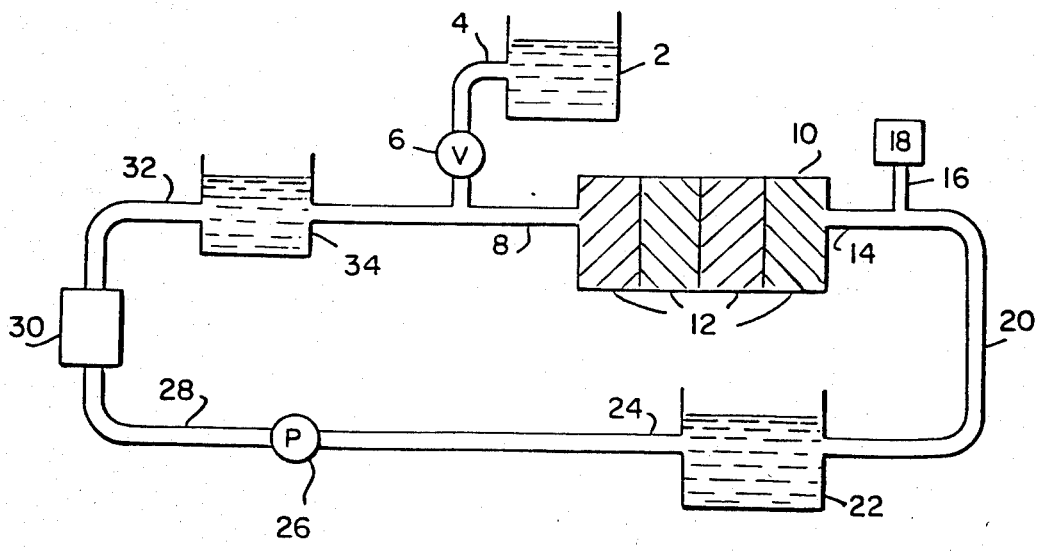
FIG. 2 discloses a copper electrolyte circulation cycle where the tankhouse is comprised of a single section.

Such a process has been discovered and is best illustrated in its broadest embodiment by viewing FIG. 2, which is a schematic flowsheet of a copper refining process in which the tankhouse refinery is comprised of a single section. Mixer tank 2 functions as a source of thiourea for the refining process, as well as the source of several other addition agents and salt additives. Thiourea can be added either continually, or periodically, into the electrolyte, depending on the particular type of system used. The thiourea in tank 2 passes through tube or other suitable flow means 4 and goes past flow regulator 6 whereupon it joins the main electrolyte circulation in tube 8. By regulating the amount of thiourea added in this manner, the inlet concentration of thiourea in tube 8 is typically kept between about 800–2500 ppb, or most typically, about 1500–2000 ppb. However, the inlet concentration should vary so that the outlet concentration of thiourea from each tankhouse section is present in at least trace concentrations, that is, at least a measurable amount, and preferably at least about 100 ppb. Surprisingly, it has been found that higher levels of thiourea than believed feasible can be used in the inlet without causing harmful results. In particular, thiourea concentations of the order of 5000 ppb have been used in the inlet, with satisfactory results. This is most unexpected, since at these high levels of thiourea it has been thought that contamination, particularly from the sulfur present in the thiourea, would damage the deposited copper cathodes. However, no economic or other benefit is derived from operating at these high levels.

Returning to FIG. 2, the electrolyte then enters into section or module 10, which is divided into many cells 12, each cell being constructed in the manner as seen in FIG. 1. However, any suitable cell or tankhouse design can be used in the process of this invention, and this particular tankhouse design, employing but a single section, is used in order to simplify the analysis. After circulating in section 10 and participating in the electrorefining of the impure anodes into pure copper cathodes, the electrolyte solution leaves through outlet tube 14. The outlet concentration of thiourea in the electrolyte is sampled at orifice 16, the sample then measured by measuring means 18, the location of which is not important, so long as the correct outlet concentrations can be quickly and accurately measured so that system changes can be promptly made.

It is preferred to determine the thiourea concentration of the electrolyte by an analytical technique known as differential pulse polarography (DPP). By using an analytical device known as a polarograph, such as the EG&G-Princeton Applied Research Model #384, which is currently sold by Princeton Applied Research Corporation, Princeton, N.J., and the operation of which is disclosed by the publication, EG&G Princeton Applied Research, Analystical Instrument Division Application Note P-2, the disclosure of which is incorporated by reference, and modifying the instrument by inserting a different reference electrode, that is, instead of using their recommended Ag-AgCl electrode, using a $KNO_3$ reference electrode instead, concentrations of thiourea of the order of 100 ppb can be registered. The tankhouse electrolyte solution is diluted to one-tenth strength and analyzed. The reason for the electrolyte dilution is to eliminate any interference in the analysis by other impurities present, particularly chlorine. The polarograph is preferably set at a slow scan rate, about 2–5 mV/sec, and a 25 mV pulse height setting, in order to best display the polarograph readings. This technique gives accurate concentration readings down to about 100 ppb, which could not be done by the recommended method of operating the machine, despite the manufacturers' claims to the contrary. However, any suitable polarograph can be quickly adapted for use in the process of this invention, and any other measuring means that can quickly and accurately generate thiourea concentrations of this order of magnitude is also perfectly suitable for the process of this invention, although none are believed currently available.

Surprisingly, it has been found that the effluent concentration of thiourea is an important parameter in optimizing tankhouse efficiency. More particularly, a thiourea effluent concentration at a value at least above trace concentrations, that is, at least a measurable amount, and preferably above about 100 ppb will lead to increased current efficiency, smoother cathodes, fewer short circuits between anode and cathode, and a lower impurity concentration in the cathodes.

After the circulating electrolyte solution is sampled at 16, it flows through tube 20 and enters tank 22, which functions as a source of fresh electrolyte, i.e. $CuSO_4$ and $H_2SO_4$. Upon exiting tank 22 the fresh electrolyte solution passes through tube 24 and pumping means 26, until entering heat exchanger 30 and tube 28, which raises the temperature of the electrolyte to about 65° C., whereupon the fluid exits through tube 32 into and out of head tank 34. The electrolyte is next fortified by thiourea and other addition agents before the entry into section 10, as the cycle is continued indefinitely. It is to be emphasized in the practice of this process that many other recycling schemes and accompanying apparatus fall within the scope of the invention, for the manner of processing the electrolyte after it has been measured for thiourea content in the effluent stream until it is fortified with a desired amount of thiourea in the inlet stream does not form a critical part of the process.

The invention in its preferred form consists of a novel improved process of electrolytic copper refining which occurs in a tankhouse or other suitable container means wherein the improvement comprises measuring the concentration of thiourea in the electrolyte outlet with a suitable measuring means, preferably by differential pulse polarography, readjusting the thiourea concentration by adding an effective amount of thiourea to the inlet stream so that the outlet concentration stays within a desired range, the range having a maximum value above which impurities develop in the copper cathodes and a minimum concentration being at least a measurable amount and preferably about 100 ppb, below which nodule formation accelerates, and periodically repeating the above procedure so that the measured outlet thiourea concentration stays between these upper and lower values, preferably about 100–2500 ppb for the typical electrorefining tankhouse.

Although applicants do not wish to be bound by theory, the utilization of DPP to measure the concentration of thiourea at various points in the tankhouse appears to have shed light on just how thiourea is consumed. The precise optimum concentration of thiourea varies from section to section and must be determined experimentally for each unit. Thiourea depletes over a period of time, even in the absence of electrolysis, although its rate of consumption appears to be proportional to the current density. The most surprising discovery has been the fact that monitoring the thiourea concentration in the manner described by applicants' process is lead to a 3–6% improvement in current efficiency, as well as up to 80% fewer short circuits. Viewing Table 1 on page 14, the current efficiences (C.E.) and number of short circuits (shorts) in a commercial refinery were tabulated over a 4 month period, the first month using conventional refining techniques, including the addition of thiourea, glue and Avitone to the electrolyte according to accepted practice, while for the last three using applicants' novel process. Initial measurements disclosed the absence of thiourea in the effluent, however, it was found that as thiourea additions to the electrolyte increased to a point where a measurable amount of thiourea was detected in the effluent, in accordance with the teachings of the invention, the number of short circuits dropped and the average current efficiency in the tankhouse modules increased. In Table II on page 16 is shown the short circuits occurring in two tankhouse modules over a nine day span, both before using the process described herein, and after using the process.

The dramatic increase in refinery current efficiency and decrease in the number of short circuits incurred, as shown in Tables I and II, is a totally unexpected development. Current densities as high as 23 amps/ft$^2$ have been attained, in contrast to more normal 17 amps/ft$^2$, without sacrificing current efficiency. Results will vary, depending on the particular individual characteristics of the tankhouse employed; however, it is clear that a substantial economic savings in a process which has been in operation substantially as is for decades is a most surprising and unexpected result.

Obviously, numerous modifications and variations of the present invention are possible in light of the above teachings. It is therefore to be understood that within the scope of the appended claims, the invention may be practiced otherwise than as specifically described herein.

TABLE I

| MONTH | MODULE | # OF SHORTS | TRIOUREA IN EFFLUENT* | C.E. % |
|---|---|---|---|---|
| Month I | A | 679 | No | 93.18 |
| | B | 749 | No | 92.43 |
| | C | 759 | No | 90.15 |
| | D | 465 | No | 93.14 |
| | E | 491 | No | 93.42 |
| Month II | A | 336 | Yes | 96.32 |
| | B | 388 | Yes | 96.11 |
| | C | 381 | No/Yes** | 94.79 |
| | D | 330 | No | 94.38 |
| | E | 322 | Yes | 94.58 |
| Month III | A | 327 | Yes | 96.54 |
| | B | 371 | Yes | 96.33 |
| | C | 270 | Yes | 95.76 |
| | D | 149 | Yes | 96.97 |
| | E | 174 | Yes | 96.34 |
| MONTH IV | A | 213 | Yes | 97.80 |
| | B | 249 | Yes | 96.83 |
| | C | 254 | Yes | 96.26 |
| | D | 133 | Yes | 97.51 |
| | E | 149 | Yes | 97.33 |

*Thiourea measurements were made weekly through months I and II up until day 19 of month III, after which they were made daily.

**Section C changed from a zero reading to a positive reading of thiourea during the middle of month II.

TABLE II

| | Short Circuits Per Day* | | | |
|---|---|---|---|---|
| | MODULE A | | MODULE B | |
| Day | Before | After | Before | After |
| 1 | 402 | 115 | 415 | 121 |
| 2 | 433 | 134 | 406 | 105 |
| 3 | 409 | 92 | 399 | 124 |
| 4 | 485 | 92 | 389 | 129 |
| 5 | 410 | 134 | 282 | 86 |
| 6 | 335 | 66 | 346 | 101 |
| 7 | 439 | 75 | 421 | 114 |
| 8 | 557 | 58 | 452 | 123 |
| 9 | 469 | 61 | 389 | 101 |

*The readings were taken at ASARCO Incorporated's Amarillo Copper Refinery Tankhouse.

We claim:

1. A copper product prepared in the electrolytic refining of copper by a method comprising:

creating in a suitable container means having inlet and outlet streams a copper refining electrolyte comprising an aqueous solution of sulfuric acid and copper sulfate of effective strength, the solution including small amounts by weight of addition agents, one of which is thiourea;

adding a sufficient amount of thiourea to the inlet stream to maintain the outlet stream concentration of thiourea at a value at least above trace concentrations; and electrorefining copper in the container means.

2. A copper product prepared in the electrolytic refining of copper by a method comprising:

creating in a suitable container means having inlet and outlet streams a copper refining electrolyte comprising an aqueous solution of sulfuric acid and copper sulfate of effective strength, the solution including small amounts by weight of addition agents, one of which is thiourea;

adding a sufficient amount of thiourea to the inlet stream to maintain the outlet stream concentration of thiourea as measured by differential pulse polarography at a value at least above trace concentrations; and electrorefining copper in the container means.

3. A copper product prepared in the electrolytic refining of copper by a method comprising:

creating in a suitable container means having inlet and outlet streams a copper refining electrolyte comprising an aqueous solution of sulfuric acid and copper sulfate of effective strength, the solution including small amounts by weight of addition agents, one of which is thiourea;

adding a sufficient amount of thiourea to the electrolyte to maintain the outlet stream concentration of thiourea at least about 100 ppb; and electrorefining copper in the container means.

4. The copper product of claim 3 wherein the outlet stream concentration of thiourea is between about 100–5000 ppb.

5. The copper product of claim 1 wherein the maximum acceptable concentration of thiourea in the outlet stream is a value above which cathode deposited copper contamination becomes significant.

* * * * *